US009626825B2

(12) United States Patent
Sugiyama

(10) Patent No.: US 9,626,825 B2
(45) Date of Patent: Apr. 18, 2017

(54) GAME MACHINE

(71) Applicant: OMRON Corporation, Kyoto-shi, Kyoto (JP)

(72) Inventor: Hiroaki Sugiyama, Gifu (JP)

(73) Assignee: OMRON Corporation, Kyoto (JP)

( * ) Notice: Subject to any disclaimer, the term of this patent is extended or adjusted under 35 U.S.C. 154(b) by 331 days.

(21) Appl. No.: 14/470,132

(22) Filed: Aug. 27, 2014

(65) Prior Publication Data

US 2015/0094154 A1 Apr. 2, 2015

(30) Foreign Application Priority Data

Sep. 30, 2013 (JP) ..... 2013-205592

(51) Int. Cl.
*G07F 17/32* (2006.01)

(52) U.S. Cl.
CPC ..... *G07F 17/3213* (2013.01)

(58) Field of Classification Search
CPC ... G07F 11/22; G07F 17/3213; G07F 17/3216
See application file for complete search history.

(56) References Cited

U.S. PATENT DOCUMENTS 4,249,737 A * 2/1981 Hancherick ..... G07F 17/3213 273/143 R
6,589,117 B1 * 7/2003 Moritome ..... A63F 13/005 463/37
2013/0084983 A1 * 4/2013 Masumi ..... G07F 17/3209 463/37
2014/0128158 A1 * 5/2014 Munakata ..... G07F 17/3209 463/31

FOREIGN PATENT DOCUMENTS

JP 2009-131509 A 6/2009
JP 2011-104175 A 6/2011

* cited by examiner

*Primary Examiner* — James S McClellan
*Assistant Examiner* — Kevin Carter
(74) *Attorney, Agent, or Firm* — Osha Liang LLP

(57) ABSTRACT

A game machine has an operation lever device disposed on a front side of the game machine, having a lever having a grip section that is configured to be held by a game player and that rotates bi-directionally with respect to a shaft, a light guide plate disposed on the grip section of the lever in a viewable manner, a light source section that supplies light into the light guide plate. The grip section is formed into a long shape. The light guide plate has a viewable surface provided with a light emission pattern for forming an image by emitted light.

7 Claims, 12 Drawing Sheets

GAME MACHINE

CROSS-REFERENCE TO RELATED APPLICATIONS

This Nonprovisional application claims priority under 35 U.S.C. §119 to Japanese Patent Application No. 2013-205592 filed in Japan on Sep. 30, 2013, the entire contents of which are hereby incorporated by reference.

BACKGROUND

Technical Field

The present invention relates to a game machine such as a slot machine.

Related Art

In a slot machine that is one kind of game machine, a plurality of reels displaying a plurality of kinds of symbols are spun. Then, according matching of symbols and a kind of matched symbols that are displayed in a window at the time when the reels stop, a prize is determined. Depending on the prize determined and the number of bets, an award is given. In the slot machine, an operation to start a spin of the reels is performed, by pushing down on a push button or by pulling down a lever which push button or lever is for starting the spin and provided on the slot machine.

In a game facility such as a casino, slot machines manufactured by not only one game machine maker but also various game machine makers are installed. Each game player selects a machine that suits his/her preference, from among slot machines manufactured by various makers, and plays a game. Accordingly, such a game facility installs slot machines popular to game players so as to ensure the game facility's superiority to other competing game facilities. Therefore, game machine makers have been continuously developing slot machines that can appeal to game players.

For example, Patent Literature 1 discloses a slot machine provided with an illuminated start lever (lever for starting a spin) on a front part (frontal part) of a housing. In the illuminated start lever, a spherical operation piece is provided to an end of the lever and illuminated. Meanwhile, Patent Literature 2 discloses an arrangement in which a plurality of light emitting sections are provided on a front surface of a container supporting a lever in a game operation lever device for turning on/off a switch by rotating the lever. The plurality of light emitting sections display a periphery of the lever with light.

CITATION LIST

Patent Literatures

Patent Literature 1

Japanese Patent Application Publication, Tokukai, No. 2009-131509 (Publication Date: Jun. 18, 2009)

Patent Literature 2

Japanese Patent Application Publication, Tokukai, No. 2011-104175 (Publication Date: Jun. 2, 2011)

SUMMARY

Techniques as disclosed in Patent Literatures 1 and 2 are intended to increase excitement of game players by a presentation in which the operation piece of the lever or the periphery of the lever is illuminated. However, various presentations with use of other techniques are required to appeal to game players who are used to seeing the presentations as described in Patent Literatures 1 and 2. Therefore, managers of gaming facilities, and the like have a strong demand for development of an operation lever device capable of further increasing excitement of game players by carrying out various presentations.

A game machine according to one or more embodiments of the present invention includes an operation lever device that is capable of further increasing excitement of game players by carrying out various presentations.

A game machine according to one or more embodiments of the present invention includes an operation lever device on a front side of the game machine, the operation lever device including: a lever including a grip section to be held by a game player and being provided so as to be capable of rotating bi-directionally with respect to a shaft, the grip section being formed into a long shape; a light guide plate provided in a viewable manner to the grip section of the lever; and a light source section supplying light into the light guide plate, the light guide plate having a viewable surface provided with a light emission pattern for forming an image by emitted light.

One or more embodiments of the present invention advantageously makes it possible to provide a game machine capable of further increasing excitement of game players by carrying out various presentations.

DETAILED DESCRIPTION

Embodiments of the present invention are discussed below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 2:
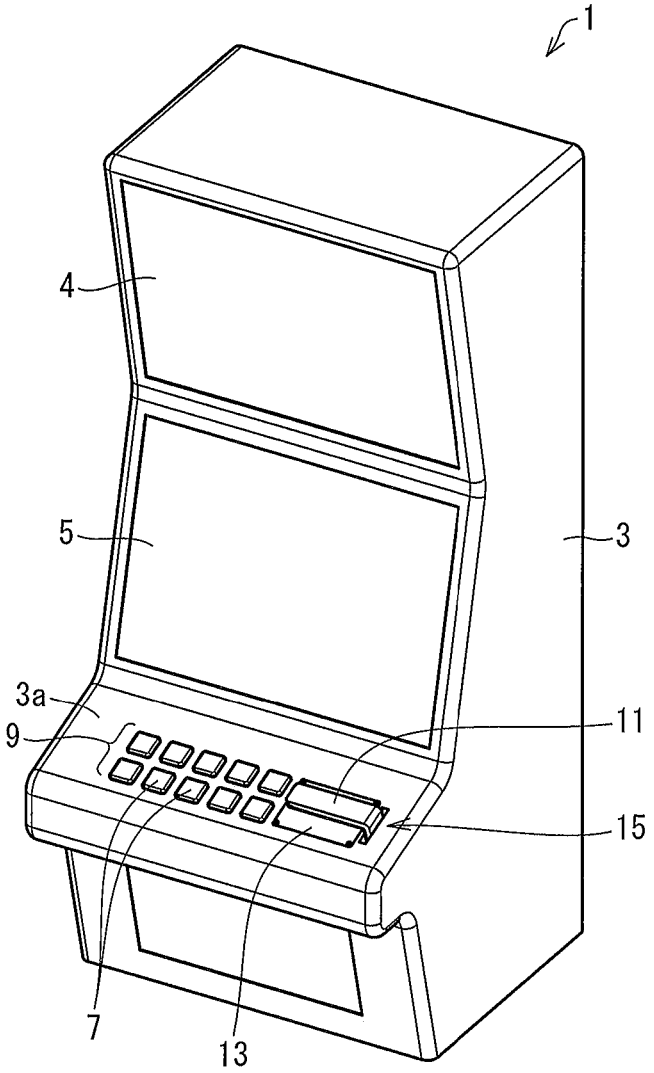
FIG. 2 is a perspective view of an overview of the slot machine including the operation lever device provided.

A slot machine is discussed as an example of a game machine, on which an operation lever device is mounted. The slot machine is one of game machines to be installed in a game hall such as a casino. FIG. 2 is a perspective view of an overview of the slot machine according to one or more embodiments of the present invention. As illustrated in FIG. 2, a slot machine 1 is provided with a reel section 5 in a center of a front surface that faces a game player (operator).

The reel section 5 includes a plurality of reels (not illustrated) on which a plurality of kinds of symbols are displayed. The plurality of reels start spinning in response to an operation that is made on a start lever (lever) 11 by a game player, and automatically stop under machine control. When the reels stop, symbols are displayed in a window (not illustrated) of the reel section 5. According to matching of the symbols and a kind of thus matched symbols on a selected line, a prize is determined. The game player is given an award in accordance with the prize determined and the number of bets.

Note that the reel section 5 may have an arrangement in which the reels are actually provided, or may alternatively have an arrangement in which the reel section 5 is made of a display screen such as a liquid crystal display screen and an image equivalent to the reels is displayed in the display screen or the like arrangement.

Above the reel section 5, a display screen 4 is provided. This display screen 4 displays various kinds of information to a game player. Meanwhile, below the reel section 5, a switch section 9 and an operation lever device 15 are provided. These switch section 9 and the operation lever device 15 are provided on a portion 3*a* of a housing 3 of the slot machine 1 which portion 3*a* is protruding forward. The switch section 9 includes a plurality of press-type switches 7. According to selection of a switch 7 to be depressed, the switch section 9 accepts a determination of the number of bets or the like. Further, in according to one or more embodiments of the present invention, when a game player selects a line or determines the number of bets by use of the operation lever device 15, the switch section 9 accepts an instruction to set the line or the number of bets.

The operation lever device 15 includes a start lever 11 and a mini-screen 13. The operation lever device 15 accepts an instruction to start spinning of the reels by an operation on the start lever 11. Further, in according to one or more embodiments of the present invention, the operation lever device 15 also accepts selection of a line or determination of the number of bets, or an instruction in a bonus game or a challenge game from a game player. Note that although FIG. 2 illustrates, as an example, an arrangement in which the operation lever device 15 is provided on a right side of the game player, the operation lever device 15 may be provided on a left side of the game player.

The slot machine 1 according to one or more embodiments of the present invention is characterized by an arrangement of the operation lever device 15. The following discusses this in detail.

Figure 1:
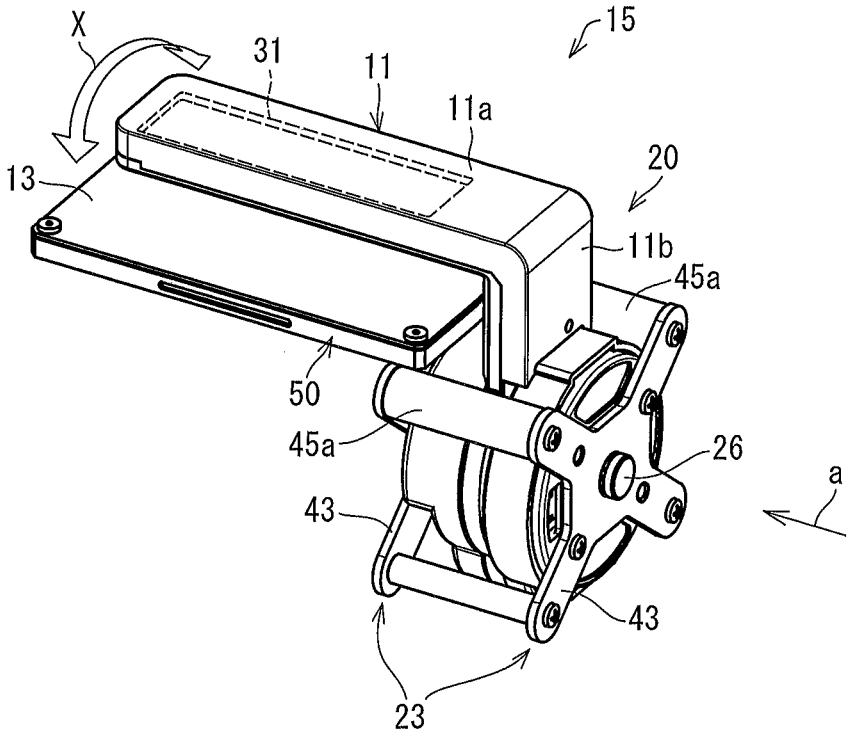
FIG. 1 is a perspective view of an overview of an operation lever device provided in a slot machine according to one or more embodiments of the present invention.

FIG. 1 is an external perspective view of the operation lever device 15 provided to the slot machine 1. As illustrated in FIG. 1, the operation lever device 15 according to according to one or more embodiments of the present invention is provided with two units including a lever unit 20 having the start lever 11 and a plate-like LCD unit 50 having the mini-screen 13. Note that in one or more embodiments of the present invention, the LCD unit 50 is not an essential constituent element, and the operation lever device 15 may include only the lever unit 20.

The start lever 11 has a letter "L" shape, to one linear portion of which a grip section 11*a* corresponds and to the other linear portion of which a stay section corresponds. The grip section 11*a* is provided so that a longitudinal direction of the grip section 11*a* is parallel to a horizontal direction. Meanwhile, the stay section 11*b* is provided with a shaft 26. An axis direction of the shaft 26 is parallel to the longitudinal direction of the grip section 11*a*. The start lever 11 is provided so as to be capable of rotating on the shaft 26. The grip section 11*a* swings above the mini-screen 13, along a cylindrical surface whose center axis is the shaft 26, as indicated by an arrow X. Such a start lever 11 is small-sized and provided on a front side of the slot machine 1. Therefore, a game player can make an operation with a smaller force and a smaller motion.

The LCD unit 50 is fixed to the lever unit 20 so that a distance is maintained between the grip section 11*a* and the mini-screen 13. Further, the grip section 11*a* is provided with a light guide plate 31. The light guide plate 31 is provided in a viewable manner so that a picture and/or a character can be displayed in the grip section 11*a*. This arrangement is discussed later in detail.

Figure 3:
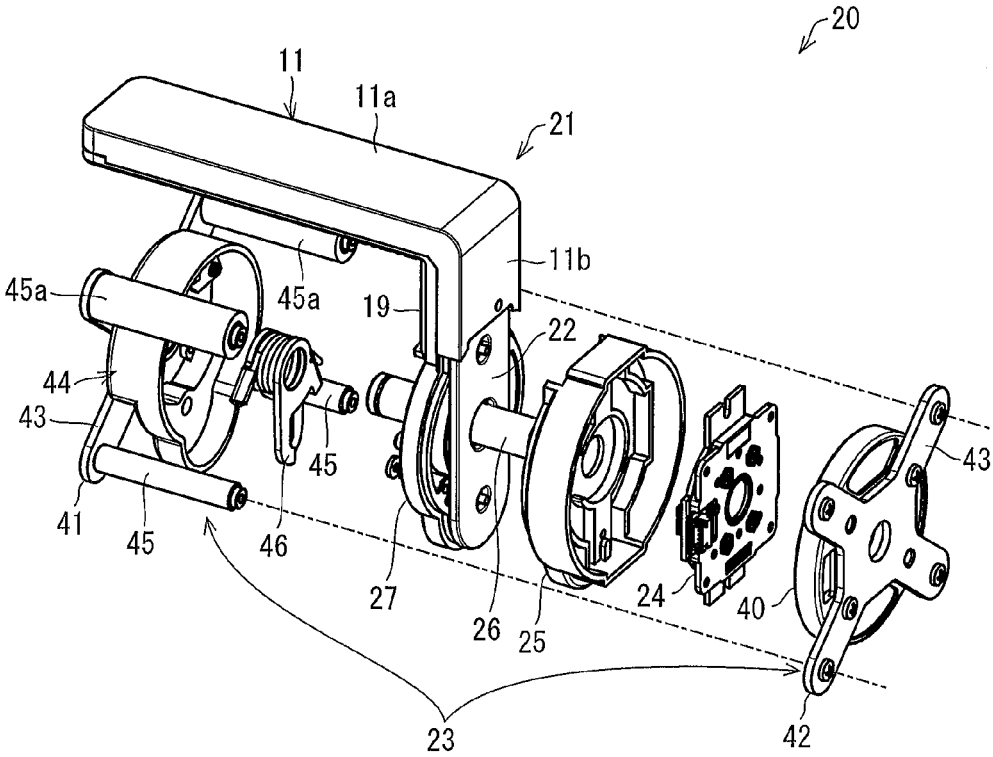
FIG. 3 is an exploded perspective view of a lever unit provided in the operation lever device.

FIG. 3 is an exploded perspective view of the lever unit 20. As illustrated in FIG. 3, the lever unit 20 includes the handle module 21 containing the start lever 11, a support mechanism 23 supporting the handle module 21 in a manner such that the handle module 21 can freely rotates, a relay board module 24 relaying electric signals inside and outside the lever unit 20, and a first case member 25 having a shape of a cylinder with a bottom.

The handle module 21 is a module including, as main members, constituent members of the start lever 11 such as an L shaped holding member 19 holding the light guide plate 31 and an L-shaped frame 22 made of a strong material like metal, and the shaft 26 inserted through the start lever 11. Both the L-shaped holding member 19 and the L-shaped frame 22 have a letter "L" shape. The L-shaped frame 22 is laminated on the L-shaped holding member 19. Respective portions of the L-shaped holding member 19 and the L-shaped frame 22 which portions correspond to the stay section 11*b* are provided with an insertion hole through which the shaft 26 is inserted. Further, the portion of the stay section 11*b* of the L-shaped holding member 19 is formed as a case supporting body 27 that has a circular outer shape having an insertion hole at the center.

The first case member 25 is set in the case supporting body 27. Further, the relay board module 24 is contained in this first case member 25. The relay board module 24 and the first case member 25 each are also provided with an insertion hole through which the shaft 26 is inserted. Because the first case member 25 is set in the case supporting body 27, movement of the first case member 25 in a circumferential direction is restricted. Consequently, the first case member 25 and the relay board module 24 integrally rotate together with the start lever 11.

The supporting mechanism 23 supports the shaft 26 of the handle module 21 in a manner such that the shaft 26 freely rotates. The supporting mechanism 23 includes a base frame section 41 and a cover frame section 41 which are provided so as to sandwich the handle module 21. The base frame section 41 and the cover frame section 41 each include a cross-shaped frame 43 having a cross shape. The shaft 26 is supported at respective ends by insertion holes formed at respective center sections of these cross-shaped frames 43. The shaft 26 is supported so that the respective end sections freely rotate.

On an inner side of the cross-shaped frame 43 of the base frame section 41, that is, a side of the base frame section 41 facing the stay section 11*b* of the start lever 11, a second case member 44 having a shape of a cylinder with a bottom is attached. This second case member 44 contains a restoration spring 46. The bottom of the second case member 44 is fixed to the cross-shaped frame 43.

The restoration spring 46 is in a coil form and contained in the second case member 44. This restoration spring 46 is provided so that the shaft 26 is inserted through the restoration spring 46. The restoration spring 46 restores, to a home position HP, a position of the start lever 11 shifted to a first end position EP1 or a second end position EP2 explained later (See FIG. 7). Here, the position is restored by use of energized spring force of the restoration spring 46.

Further, on the inner side of the cross-shaped frame 43 of the base frame section 41, fixation sections 45 in a pole form are provided in a standing manner to respective end sections of arms extending in four directions from the cross-shaped frame 43. The fixation sections 45 are screwed to the cross-shaped frame 43 of the cover frame section 42. Upper two fixation sections 45*a* out of the four fixation sections 45 each serve as a stopper (restriction member) that, when the start lever 11 comes in contact with either of the fixation sections 45*a*, restricts any further rotation of the start lever 11.

Meanwhile, on an inner side of the cross-shaped frame 43 of the cover frame section 42, that is, on a side of the cover frame section 42 facing the first case member 25, a cover member 40 is fixed. The cover member 40 is fit in the first case member 25, and the first case member 25 slides on a circumference of the cover member 40. Further. the cover member 40 is provided with an opening through which a harness connected to the relay board module 24 is passed.

Figure 4:
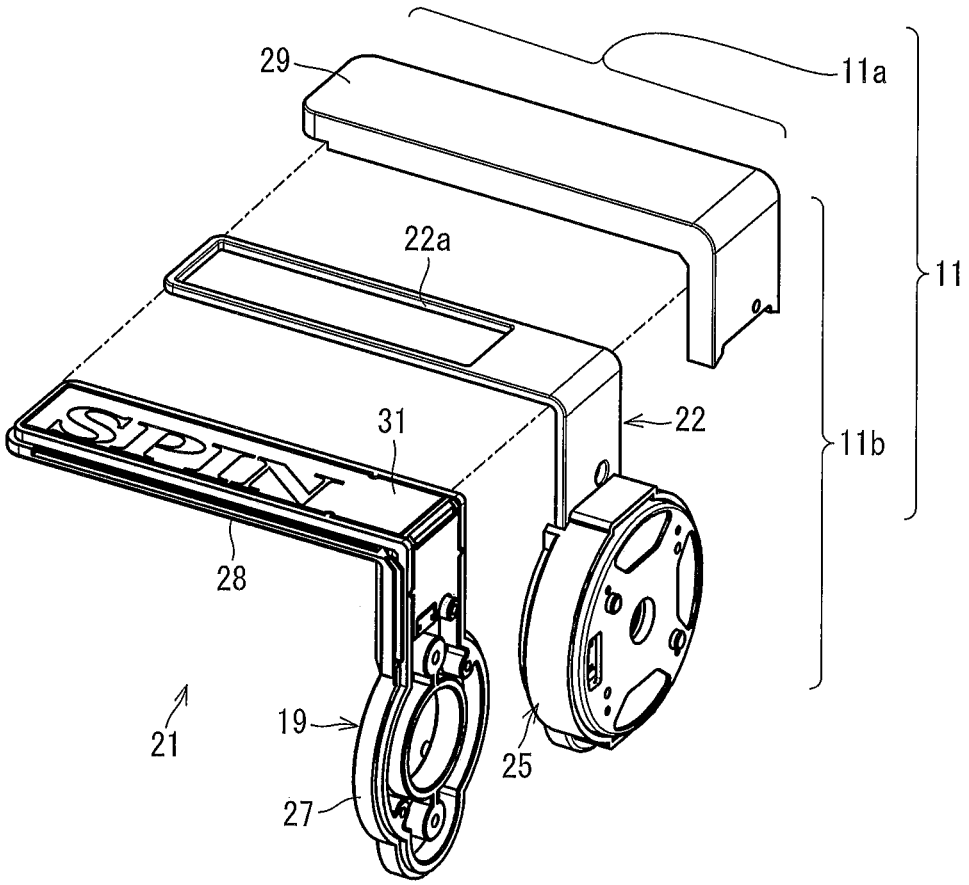
FIG. 4 is an exploded perspective view of an essential part of a handle module provided in the lever unit.
Figure 5:
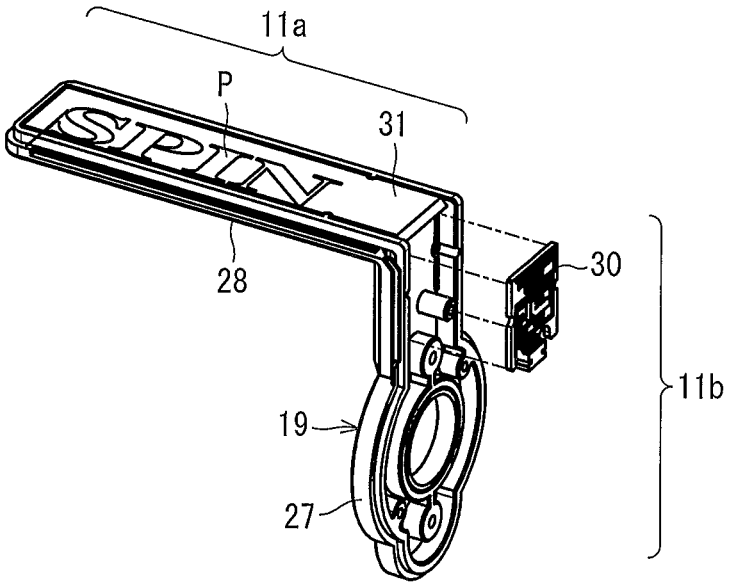
FIG. 5 is an exploded perspective view of an essential part of the handle module.

FIG. 4 is an exploded perspective view of an essential part of the handle module 21 in the lever unit 20. Note that FIG. 4 illustrates a state where the cover member 40 of the cover frame section 42 is fit in the first case member 25. Further, FIG. 5 is an exploded perspective view illustrating an essential part of the handle module 21. FIG. 5 shows the light guide plate 31 held by the L-shaped holding member 19 and a luminous substrate 31 that supplies light into the light guide plate 31.

As illustrated in FIG. 4, the start lever 11 includes the light guide plate 31, the L-shaped holding member 19, the L-shaped frame 22, upper and lower cover members 28 and 29 covering an area from the grip section 11*a* to an upper part (part above a position where the first case member 25 is attached) of the stay section 11*b*.

The light guide plate 31 is attached to a portion of the L-shaped holding member 19 corresponding to the grip section 11*a*. The L-shaped holding member 19 is provided with an opening (not illustrated) in an area corresponding to a display area of the light guide plate 31. Similarly, the L-shaped frame 22 is provided with an opening 22*a* corresponding to the display area of the light guide plate 31. In addition, the upper and lower cover members 28 and 29 each has a portion made of a transparent material, which portion corresponds to at least the display area of the light guide plate 31.

Further, as illustrated in FIG. 5, the luminous substrate (light source section) 30 is provided to an upper part of a portion of the L-shaped holding member 19 which portion corresponds to the stay section 11*b*. The luminous substrate 30 supplies light into the light guide plate 31. The luminous substrate 30 is provided with a light source such as LED. According to one or more embodiments of the present invention, the light source is a full color light source capable of coloring the light guide plate 31 in full color, but may alternatively be a monochromatic light source.

In the display area (viewable surface) of the light guide plate 31, a light emission pattern P is formed. The light emission pattern P forms a character or a picture (image) by light emitted to an outside of the light guide plate 31. In examples of FIGS. 4 and 5, as the light emission pattern P, the characters "SPIN" indicative of an instruction to start a spin of the reels are formed.

Figure 6:
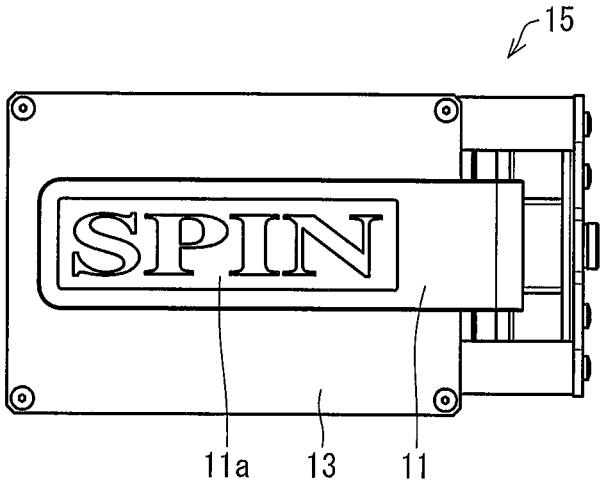
FIG. 6 is an explanatory view illustrating an example display of a light guide plate provided to a start lever in the operation lever device.

In the operation lever device 15 where such a light emission pattern P is formed, when light is supplied into the light guide plate 31 from the luminous substrate 30, the characters "SPIN" are displayed in the grip section 11*a* of the start lever 11, as illustrated in FIG. 6. FIG. 6 is an explanatory view illustrating an example display of the light guide plate 31 that is provided to the start lever 11 in the operation lever device 15.

Figure 7:
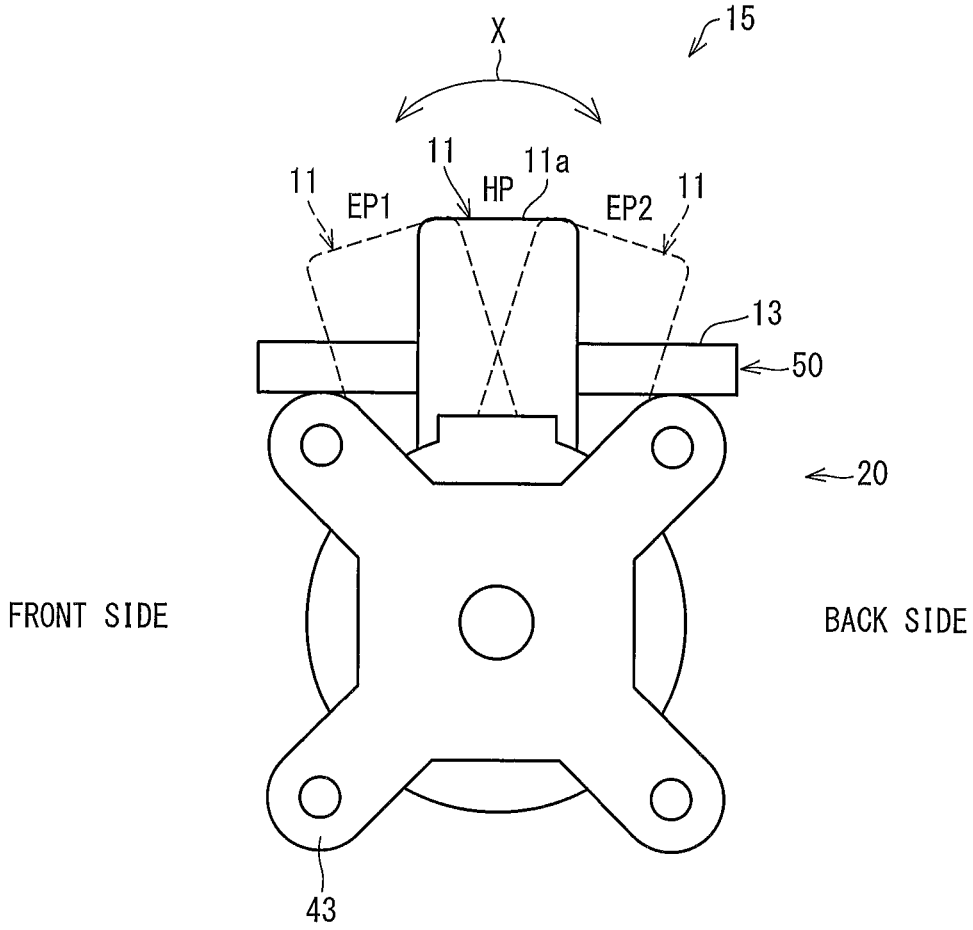
FIG. 7 is an explanatory view illustrating a position that can be taken by the start lever in the operation lever.

FIG. 7 is an explanatory view illustrating a position that can be taken by the start lever 11 in the operation lever device 15. FIG. 7 is a view of the operation lever device 15 in a case where the operation lever device 15 is viewed from a direction indicated by an arrow a in FIG. 1. The left side of FIG. 7 corresponds to a front side of the slot machine 1 while the right side of FIG. 7 corresponds to the back side of the slot machine 1.

As illustrated in FIG. 7, the operation lever device 15 of the slot machine 1 according to one or more embodiments of the present invention can take three positions, that is, the home position HP, the first end position EP1 and the second end position EP2.

The home position HP is a position where the mini-screen 13 and the grip section 11*a* are opposed to each other in parallel with each other. The start lever 11 is provided so that the start lever 11 returns to the home position HP by an action of the restoration spring 46 (see FIG. 3) unless no force in a rotating direction is applied to the grip section 11*a*. The first end position EP1 is a position of the grip section 11*a* pulled down to the front side of the slot machine 1 from the home position HP. The second end position EP2 is a position of the grip section 11*a* pushed up to the back side of the slot machine 1 from the home position HP.

By use of the operation lever device 15 according to according to one or more embodiments of the present invention, instructions can be inputted by moving the grip section 11*a* in both upward and downward directions from the home position HP at a center position. Accordingly, as compared to a start lever that moves in only one direction from the home position HP, various operations become possible. Consequently, it becomes possible to change a presentation in accordance with a position of the start lever 11, or the like. This makes it possible to carry out various presentations.

Figure 8:
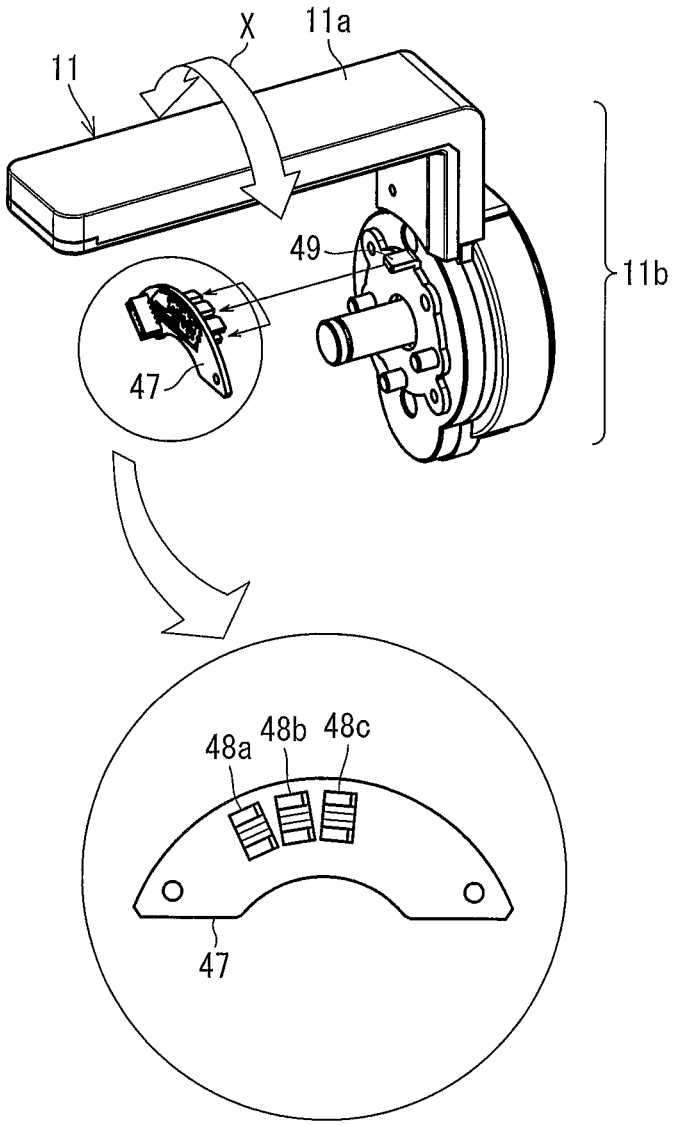
FIG. 8 is an explanatory view illustrating a positional relationship between the start lever and an encoder in the operation lever device.

FIG. 8 is an explanatory view illustrating a positional relationship between the start lever 11 and an encoder 47 in the operation lever device 15. As illustrated in FIG. 8, the operation lever device 15 is provided with an encoder 47 for detection of a position of the start lever 11. This encoder 47 includes detection sections 48*a* to 48*c* each made of a photomicrosensor. The encoder 47 is attached to the bottom of the second case member 44 of the base frame section 41 in the supporting mechanism 23 (see FIG. 3).

The position of the start lever 11 is detected, according to which of the three detection sections 48*a* to 48*c* is light-shielded by a detecting portion 49 due to rotation of the start lever 11, which detecting portion 49 is provided in a position facing a bottom section of the stay section 11*b* of the start lever 11. In a state where no operation is carried out on the start lever 11, the detection section 48*b* at the center is light-shielded and as a result, it is detected that the start lever 11 is at the home position HP. When the start lever 11 is pulled down and the detecting section 48*a* on the left (on the front side) is light-shielded, it is detected that the start lever 11 is at the first end position EP1. When the start lever 11 is pulled up and the detecting section 48*c* on the right (on the back side) is light-shielded, it is detected that the start lever 11 is at the second end position EP2. Note that the position of the start lever 11 may be detected by an arrangement in which, in place of the encoder 47, a microswitch is provided at each of the end positions EP1 and EP2.

Further, although not illustrated, a mechanism for locking rotation of the start lever 11 is provided in the operation lever device 15. This locking mechanism has two types of locks including a full lock that restricts the rotation of the start lever 11 in both the upward and downward directions and a one-side lock that restricts the rotation of the start lever 11 in either one of these directions. Such provision of the locking mechanism makes it possible to arrange such that only an operation of the start lever 11 relevant to play using the slot machine 1 become possible. Further, it also becomes possible to prevent an erroneous operation. That is, for example, in a case where the start lever 11 is to be pulled down so as to instruct rotation of the reels, the start lever 11 is prevented from rotating in an upward direction.

Figure 9:
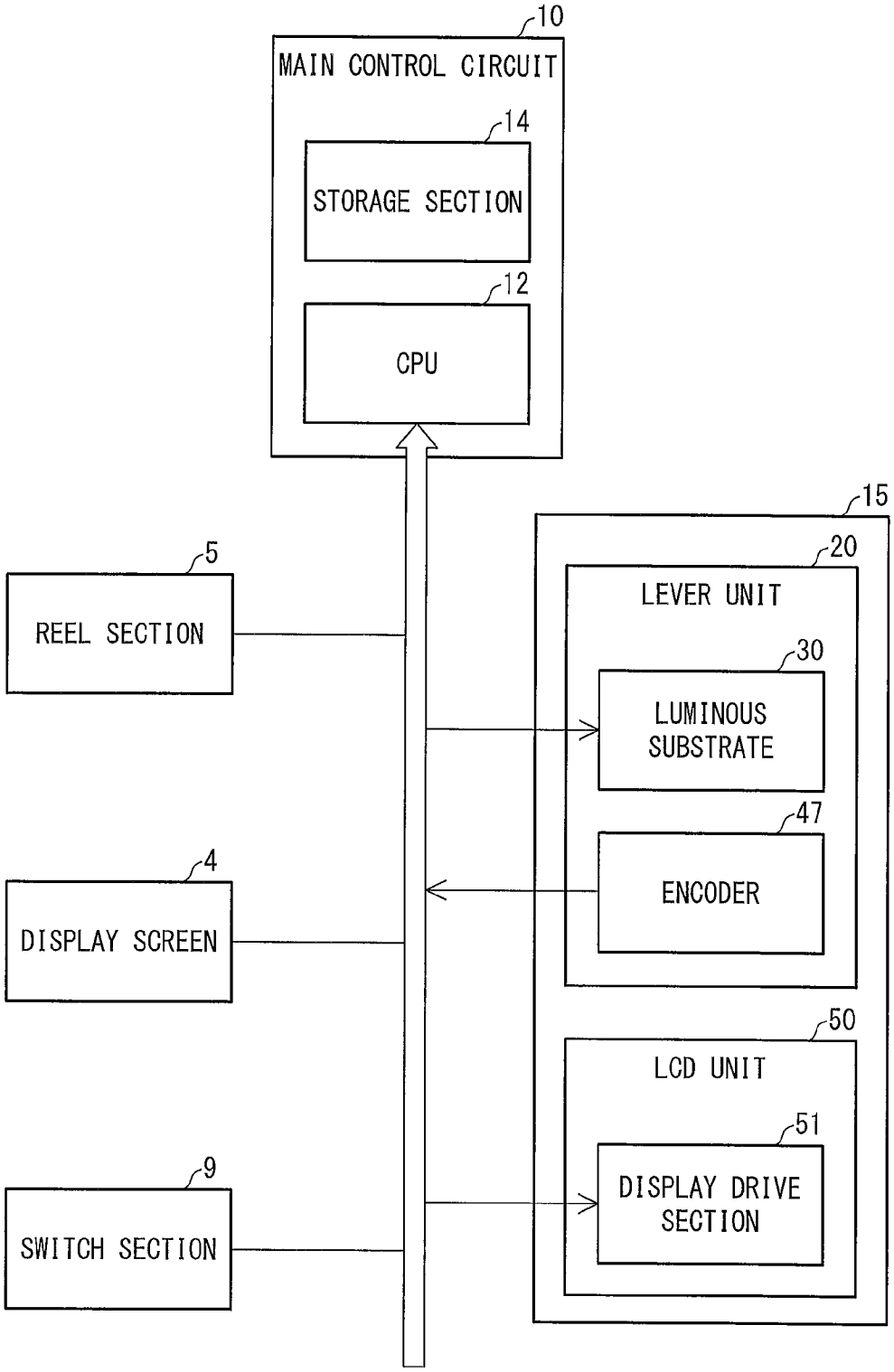
FIG. 9 is a block diagram illustrating an essential part of a control system of a slot machine.

FIG. 9 is a block diagram illustrating an essential part of a control system of the slot machine 1. The slot machine 1 is provided with a main control circuit 10 including a CPU 12 and a storage section 14. The main control circuit 10 controls each section of the slot machine 1, such as the reel section 5, the display screen 4, the switch section 9, the operation lever device 15, and the like. In the storage section 14, various presentation contents are stored. The CPU 12 reads out any of these presentation contents from the storage section 14 and executes a presentation according to the presentation content read out, by driving each section of the slot machine 1.

Into the main control circuit 10, the encoder 47 in the operation lever device 15 inputs a signal in accordance with a position of the start lever 11. Further, the main control circuit 10 outputs a control signal to the luminous substrate 30 in the operation lever device 15, and thereby causes the light guide plate 31 to light up in accordance with the presentation content. The main control circuit 10 also outputs a video signal to a display driving section of the LCD unit 50 in the operation lever device 15, and causes the LCD unit 50 to carry out a display in accordance with the presentation content. Note that the operation lever device 15 can be arranged to include only a control circuit that carries out only a control relevant to the operation lever device 15.

Figure 10:
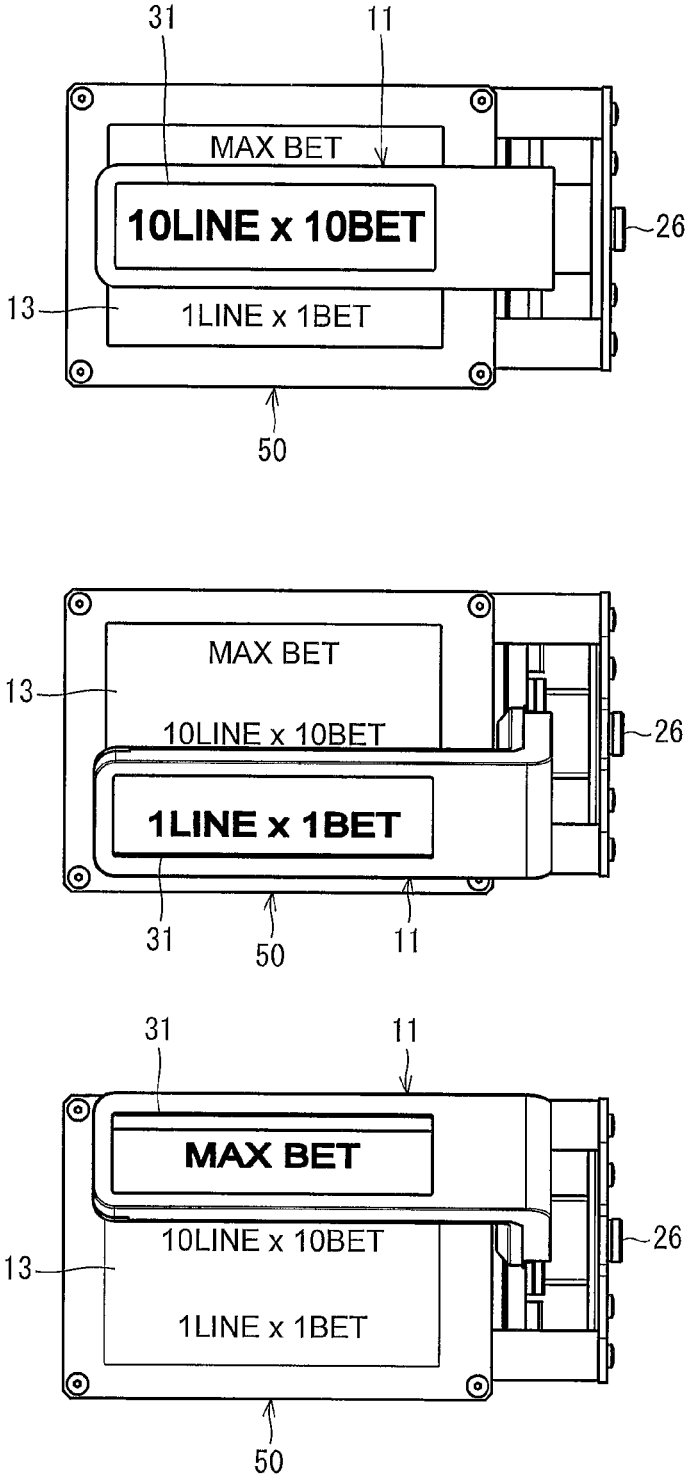
FIG. 10 is an explanatory view illustrating a presentation carried out at the time when the number of bets is selected by use of the operation lever device.

FIG. 10 is an explanatory view illustrating a presentation carried out at the time when the number of bets is selected by use of the operation lever device 15. As illustrated in FIG. 10, the main control circuit 10 causes the mini-screen 13 of the LCD unit 50 to display three conditions: "1 LIN×1 BET", "10 LIN×10 BET", and "MAX BET". At this time, the main control circuit 10 causes these selection conditions to be displayed in three vertically aligned rows, in accordance with positions that the grip section 11*a* of the start lever 11 can take. Further, the main control circuit 10 carries out a presentation in which a display form of the three conditions are switched in accordance with respective positions of the start lever 11.

In other words, when the start lever 11 is at the home position HP, display of "10 LIN×10 BET" at a center section of the mini-screen 13 is carried out in an enlarged and emphasized manner as compared to display of the other conditions. When the start lever 11 is pulled down and moves to the first end position EP1, display of "1 LIN×1 BET" at a lower section of the mini-screen 13 is carried out in an enlarged and emphasized manner as compared to displays of the other conditions. Similarly, when the start lever 11 is pushed up and moves to the second end position EP2, display of "MAX BET" at an upper section of the mini-screen 13 is carried out in an enlarged and emphasized manner as compared to displays of the other conditions. This allows a game player to easily check the number of bets corresponding to the position of the start lever 11.

The game player rotates the start lever 11 and stops the start lever 11 at a position of a condition selected, while checking the conditions viewed through the light guide plate 31. In this state, the game player depresses a predetermined switch in the switch section 9 provided on the slot machine 1, and thereby determines a selection of the condition. As a result, the main control circuit 10 determines which one of the three conditions displayed on the mini-screen 13 is selected based on the position of the start lever 11 which position is inputted from the encoder 47. Then, the main control circuit 10 carries out an operation in accordance with the selected condition.

Figure 11:
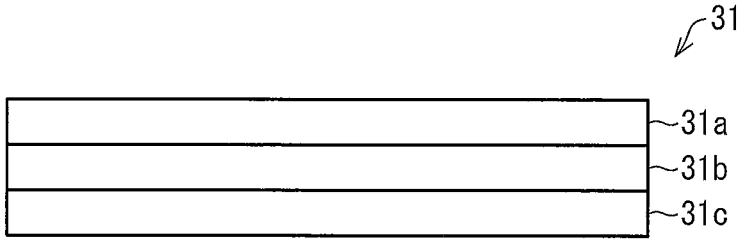
FIG. 11 is an explanatory view illustrating an example where a plurality of light guide plates are provided in a laminated manner in the start lever of the operation lever device.

Alternatively, as illustrated in FIG. 11, the grip section 11*a* can be arranged such that the light guide plate 31 is plurally provided in a laminated manner. In an arrangement where three light guide plates 31*a* through 31*c* are laminated as illustrated in FIG. 11, three sets of light sources such as LEDs are provided in the luminous substrate 30, respectively for supplying light to the three light guide plates 31*a* through 31*c*. These three sets of light sources are driven independently from one another. By forming a light emission patter P for forming a different character and/or a picture (image) in each of the three light guide plates 31*a* through 31*c*, it becomes possible to carry out more various presentations.

Figure 12:
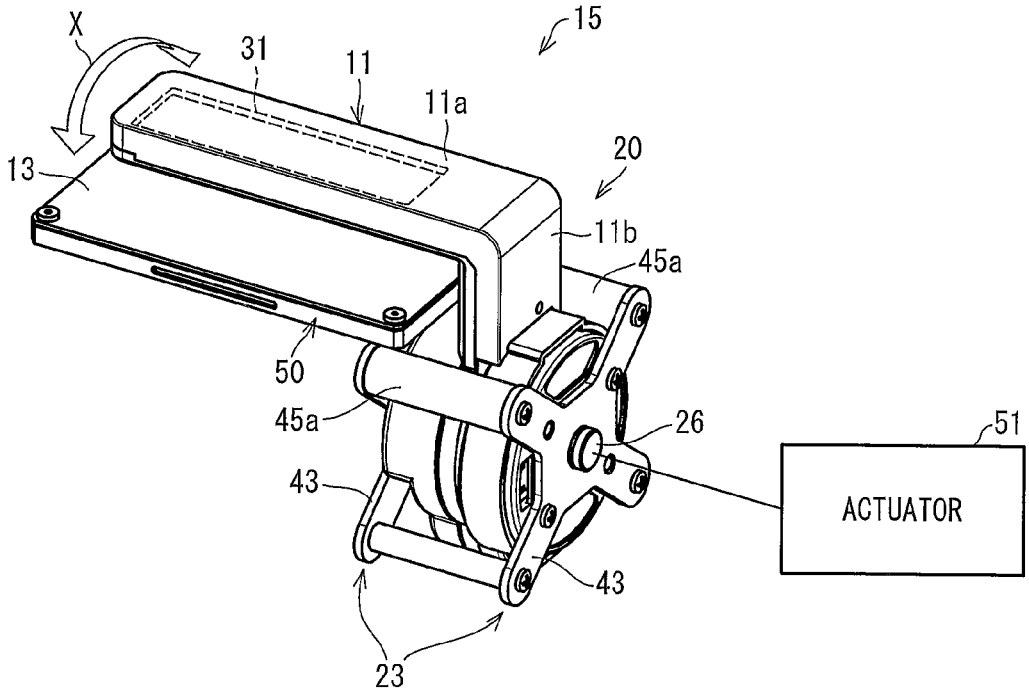
FIG. 12 is an explanatory view illustrating an arrangement where an actuator causing a start lever to automatically rotate is provided in an operation lever device that is provided in the slot machine according to one or more embodiments of the present invention.

In addition, the operation lever device 15 may be arranged to include an actuator (drive means) 51 provided to the shaft 26, as illustrated in FIG. 12. Then, by rotating the start lever 11 automatically, presentations may be carried out. In this arrangement, the actuator 51 is driven by the main control circuit 10.

In the operation lever device 15 according to one or more embodiments of the present invention, the start lever 11 having the letter "L" shape is provided in a manner such that the start lever 11 can rotate on the shaft 26 that is provided to the stay section 11*b* and that has an axis direction parallel to the longitudinal direction of the grip section 11*a*. This arrangement is an example of the operation lever device 15. The operation lever device 15 may be alternatively arranged such that a start lever is caused to rotate on a shaft provided to a stay section, which shaft has an axis direction parallel to a normal direction of the mini-screen 13 in the LCD unit 50. In this case, a grip section of the start lever moves, above the mini-screen 13, like a clock hand in a plane that is a predetermined distance apart from the mini-screen 13.

As described above, the operation lever device 15 of the slot machine 1 according to one or more embodiments of the present invention makes it possible to display a character and/or a picture in the grip section 11*a* of the start lever 11.

This makes it possible to provide various presentations for game players. Furthermore, the mini-screen 13 is provided below the grip section 11*a* of the start lever 11 and a video image in the mini-screen 13 can be viewed through the light guide plate 31. This makes it possible to provide further more various presentations by use of a combination of a presentation with display in the grip section 11*a* and a presentation with a video image with use of the mini-screen 13.

In addition, by combining the video image in the mini-screen 13 and an operation of the start lever 11, it is possible to select a line or determine the number of bets. Further, such a combination with the mini-screen 13 allows the operation lever device 15 to be also used as a controller for a bonus game or a challenge game.

A game machine according to one or more embodiments of the present invention includes an operation lever device on a front side of the game machine, the operation lever device including: a lever including a grip section to be held by a game player and being provided so as to be capable of rotating bi-directionally with respect to a shaft, the grip section being formed into a long shape; a light guide plate provided in a viewable manner to the grip section of the lever; and a light source section supplying light into the light guide plate, the light guide plate having a viewable surface provided with a light emission pattern for forming an image by emitted light.

In the above arrangement, it is possible to display an image in the grip section of the lever positioned on a front side of the game machine. This makes it possible to carry out more various presentations as compared to a conventional lever that only lights up, by displaying, on the grip section of the lever, a character and/or a picture that may increase excitement of a game player.

Moreover, the game machine according to one or more embodiments of the present invention is arranged such that: the operation lever device further includes a display section provided below the grip section; and the display section is provided so that when viewed from above, a screen of the display section overlaps with an area where the grip section moves by rotation.

In the above arrangement, it is possible to display an image (video image) also in the display section provided below the grip section. This allows a game player to view the image in the display section through the light guide plate. Therefore, further-more various presentations can be carried out by a combination of the lever where an image is displayed in the grip section and the display section provided below the grip section.

Further, the game machine according to one or more embodiments of the present invention is arranged such that: the light guide plate is plurally provided so that the operation lever device includes a plurality of light guide plates provided in a laminated manner; and the light source section is capable of supplying light independently into each of the plurality of light guide plates.

In the above arrangement, the plurality of light guide plates can have different images, respectively, and a light guide plate to be caused to light up can be switched in accordance with an intended purpose. This makes it possible to carry out more-various presentations.

Further, the game machine according to one or more embodiments of the present invention may be arranged such that: the lever has a letter "L" shape; the grip section is provided so that a longitudinal direction of the grip section corresponding to one linear portion of the letter "L" shape is parallel to a horizontal direction, while the shaft is provided to a stay section corresponding to the other linear portion of the letter "L" shape; and the shaft has an axis direction parallel to the longitudinal direction of the grip section.

In the above configuration, the grip section moves along a cylindrical surface whose center axis is the shaft. This allows a game player, who operates the lever in front of the game machine, to operate the lever by moving the game-player's wrist back and forth. Therefore, the lever has an excellent operability. Furthermore, the longitudinal direction of the grip section is kept in the horizontal direction. Accordingly, a direction of an image displayed in the grip section does not change. Therefore, even when an image, such as an image of a character, whose direction matters is displayed, legibility of the image is hardly impaired by rotation of the lever.

Further, the game machine according to one or more embodiments of the present invention is arranged such that: the operation lever device is further provided with a pair of restriction members which restrict rotation of the lever when the lever comes in contact with either of the restriction members; and in a state where the rotation of the lever is restricted by the restriction members, a predetermined distance is maintained between the grip section and a surface below the grip section.

In the above configuration, it is possible to avoid a hard contact of game-player's fingers holding the grip section on the surface below the grip section. This makes it possible to improve safety.

Further, the game machine can be arranged to further include a control circuit for carrying out driving, by outputting a signal in accordance with a presentation to the light source section in the operation lever device. This makes it possible to carry out various presentations by use of the light guide plate provided to the grip section of the lever.

In this case, the game machine may be arranged to further include: a drive means for rotating the shaft in the operation lever device, the control circuit driving the shaft in accordance with a presentation, by use of the drive means. This makes it possible to carry out more various presentations by automatically moving the lever capable of carrying out a display.

Further, the game machine according to one or more embodiments of the present invention can be arranged to further include a control circuit for carrying out driving, by outputting a video signal in accordance with a presentation of the display section in the operation lever device. This makes it possible to carry out various presentations by additionally using the display section provided below the grip section of the lever.

The present invention is not limited to the description of the embodiments above, but may be altered by a skilled person within the scope of the claims. That is, an embodiment based on a proper combination of technical means disclosed in different embodiments is encompassed in the technical scope of the present invention.

One or more embodiments of the present invention is applicable to a game machine etc., for example, a slot machine, which includes a lever that is provided so as to freely rotate bi-directionally with respect to a shaft.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

1 slot machine (game machine)
3 housing
4 display screen
5 reel section
9 switch section
10 main control circuit (control circuit)
11 start lever (lever)
11*a* grip section
11*b* stay section
13 mini-screen
14 storage section
15 operation lever device
20 lever unit
21 handle module
23 supporting mechanism
24 relay board module
26 shaft
30 luminous substrate (light source section)
31 light guide plate
43 cross-shaped frame
47 encoder
50 LCD unit (display section)
51 actuator (drive means)
P light emission pattern

The invention claimed is:

1. A game machine comprising:

an operation lever device disposed on a front side of the game machine, comprising:

a lever comprising a grip section that is configured to be held by a game player and that rotates bi-directionally with respect to a shaft;

a light guide plate disposed on the grip section of the lever in a viewable manner; and a light source section that supplies light into the light guide plate, wherein the grip section is formed into a long shape, wherein the light guide plate has a viewable surface provided with a light emission pattern for forming an image by emitted light, wherein the operation lever device further comprises a display section provided below the grip section, and wherein the display section is disposed such that when viewed from above, a screen of the display section overlaps with an area where the grip section moves by rotation.

2. A game machine comprising;

an operation lever device disposed on a front side of the game machine, comprising:

a lever comprising a grip section that is configured to he held by a game player and that rotates bi-directionallv with respect to a shaft;

a light guide plate disposed on the grip section of the lever in a viewable manner; and a light source section that supplies light into the light guide plate, wherein the grip section is formed into a long shape, wherein the light guide plate has a viewable surface provided with a light emission pattern for forming an image by emitted light, wherein the operation lever device comprises a plurality of the tight guide plates, disposed in a laminated manner, and wherein the light source section supplies light independently into each of the plurality of light guide plates.

3. The game machine as set forth in claim 1, wherein the lever is an L-shaped lever, wherein a longitudinal direction of the grip section corresponding to one of two linear parts of the L-shaped lever is parallel to a horizontal direction, wherein the shaft is provided to a stay section corresponding to the other of the two linear parts of the L-shaped lever, and wherein the shaft has an axis direction parallel to the longitudinal direction of the grip section.

4. The game machine as set forth in claim 3, wherein the operation lever device is further provided with a pair of restriction members which restrict rotation of the lever when the lever comes in contact with either of the restriction members; and wherein, in a state where the rotation of the lever is restricted by the restriction members, a predetermined distance is maintained between the grip section and a surface below the grip section.

5. The game machine as set forth in claim 1, further comprising a control circuit for driving the light source section, by outputting a signal in accordance with a presentation to the light source section in the operation lever device.

6. The game machine as set forth in claim 5, further comprising:

an actuator that rotates the shaft in the operation lever device, wherein the control circuit drives the actuator to drive the shaft in accordance with a presentation.

7. The game machine as set forth in claim 1, further comprising a control circuit for driving the display section, by outputting a video signal in accordance with a presentation of the display section in the operation lever device.

* * * * *